US007591246B2

(12) United States Patent
Beardmore et al.

(10) Patent No.: US 7,591,246 B2
(45) Date of Patent: Sep. 22, 2009

(54) ISOLATED FUEL DELIVERY SYSTEM

(75) Inventors: John M. Beardmore, Howell, MI (US); Matthew Timothy Hamilton, Novi, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 281 days.

(21) Appl. No.: 11/333,052

(22) Filed: Jan. 17, 2006

(65) Prior Publication Data

US 2007/0163545 A1 Jul. 19, 2007

(51) Int. Cl.
*F02M 69/46* (2006.01)

(52) U.S. Cl. ..... 123/456; 123/470; 123/469; 411/367; 411/81

(58) Field of Classification Search ..... 123/468, 123/469, 470, 467, 456; 411/367, 81
See application file for complete search history.

(56) References Cited

U.S. PATENT DOCUMENTS 4,286,777 A * 9/1981 Brown ..... 267/294
4,306,708 A * 12/1981 Gassaway et al. ..... 267/141.3
4,428,331 A * 1/1984 Zang et al. ..... 123/184.31
4,863,329 A * 9/1989 Wilson ..... 411/339
5,044,338 A * 9/1991 Shelton ..... 123/469
5,172,671 A * 12/1992 Peters et al. ..... 123/470
5,735,247 A * 4/1998 Tsuzuki et al. ..... 123/470
6,178,950 B1 * 1/2001 Stockner et al. ..... 123/470
6,732,711 B2 * 5/2004 Yanagii ..... 123/469
2002/0138983 A1 * 10/2002 Dallmeyer et al. ..... 29/890.124
2004/0098927 A1 * 5/2004 Haytayan ..... 52/40

FOREIGN PATENT DOCUMENTS

JP 2001032931 A 2/2001
JP 2001263195 A 9/2001

* cited by examiner

*Primary Examiner*—Stephen K Cronin
*Assistant Examiner*—J. Page Hufty

(57) ABSTRACT

An isolated fuel delivery system for an internal combustion engine includes a fuel rail with a clamping method operable to retain an isolating member with respect to the fuel rail. The isolating member operates to isolate the vibratory motion of the fuel delivery system form the attachment point or points. The attachment point is typically a cylinder head of the internal combustion engine. Additionally, an isolating ring assembly is provided having a first and second stiffening member with an isolating ring member disposed therebetween. The isolating ring assembly is disposed between a fuel injector of the isolated fuel delivery system and the cylinder head. The isolating ring member operates to isolate the vibratory motion of the fuel injector from the internal combustion engine.

7 Claims, 4 Drawing Sheets

ISOLATED FUEL DELIVERY SYSTEM

TECHNICAL FIELD

The present invention relates to fuel delivery systems for internal combustion engines.

BACKGROUND OF THE INVENTION

Fuel delivery systems for internal combustion engines are available in many different varieties. One of the more common of which is the port fuel injection system. The port fuel injection system utilizes a plurality of fuel injectors each of which delivers a predetermined amount of fuel to the inlet port of an associated combustion chamber. In such systems, the fuel injectors are mounted in sockets or injector bosses of a manifold or fuel rail, which operates to communicate fuel to each of the injectors.

Recent advances in fuel delivery and combustion research has allowed direct injection, or DI, fuel delivery systems to increase in popularity. The DI fuel delivery system provides a fuel injector within the cylinder head of the internal combustion engine. The DI fuel injector operates to inject a predetermined amount of fuel directly into the combustion chamber. Since the gas pressure within the combustion chamber is orders of magnitude greater than that of the intake port, the DI fuel rail and fuel injector operate at a much higher fuel pressure than similar components within the port fuel injection system. The DI fuel delivery system enables higher peak power levels, improved fuel economy, and lower emissions. These beneficial aspects of the DI fuel delivery system are a result of the precise metering of the fuel injected into the combustion chamber as well as improved intake airflow into the combustion chamber.

The electromagnetic fuel injectors of the DI fuel delivery system deliver fuel to the combustion chamber in metered pulses, which are timed to control the amount of fuel delivered and to coordinate such delivery with specific points of the operational cycle of the engine. The sequential energization of the fuel injectors may operate to induce pressure pulsations within the fuel rail, which may produce noise-emitting vibrations. The transmission of vibrational energy generated within the DI fuel delivery system to the engine structure may follow two paths; from the fuel injector to the cylinder head and from the fuel rail to the respective attachment point, which is most likely the cylinder head.

SUMMARY OF THE INVENTION

Accordingly, the isolated fuel delivery system of the present invention reduces the transmission of noise producing, high frequency vibrations from the fuel injector and fuel rail to the engine.

Provided is an isolated fuel delivery system for an internal combustion engine having a cylinder head and an intake manifold. The isolated fuel delivery system includes a fuel rail operable to deliver fuel to at least one fuel injector. The isolated fuel delivery system also includes at least one clamping member operable to removably attach the fuel rail to the internal combustion engine. An isolating member is at least partially disposed between the clamping member and the fuel rail. The isolator member operates to absorb vibrations of the fuel rail.

Additionally, a first and a second of the at least one clamping members may be provided, with each having a first and second edge. The first and second clamping members may have a lip portion at least partially disposed about at least one of the first and second edges. The lip portion is spaced from the fuel rail by a predetermined amount and is operable to locate and limit the movement of the isolating member with respect to the first and second clamping members. The clamping member may permit the fuel rail to move with respect to the clamping member to enable changes in orientation of the fuel rail and the fuel injector. The clamping member may be integral with one of the cylinder head and the intake manifold and may extend substantially the length of the fuel rail.

Additionally, an isolated fuel delivery system for an internal combustion engine having a cylinder head and an intake manifold is provided having a fuel rail operable to deliver fuel to at least one fuel injector. The isolated fuel delivery system also includes a one-piece clamping member having a clamping portion with a first and a second mounting flange extending therefrom and defining a bore operable to receive a fastener. The fastener is operable to removably attach the fuel rail to the internal combustion engine. An isolating member is at least partially disposed between the clamping portion and the fuel rail and operates to isolate the fuel rail.

The isolated fuel delivery system may further include a shim block disposed between the first and second mounting flanges and operable to engage a first tab of the first mounting flange and a second tab of the second mounting flange such that the shim block and the one-piece clamping member cooperate to provide pre-compression to the isolating member. The one-piece clamping member may extend substantially the length of the fuel rail.

Also provided is an isolated fuel delivery system for an internal combustion engine having a fuel rail operable to deliver fuel to at least one fuel injector. The fuel rail also includes at least one mounting boss portion. The mounting boss portion defines a bore that is dimensioned to receive a fastener. The fastener is operable to removably attach the fuel rail to the engine. Also provided is a plurality of isolating members, each disposed at a respective opposite axial end of the mounting boss and operable to damp the vibrations of the fuel rail.

Any of the above described embodiments of the isolated fuel delivery system may include an isolating ring assembly disposed between the fuel injector and the cylinder head and operable to isolate the fuel injector. The isolating ring assembly may be an elastomeric isolating ring member disposed between two stiffening members. Additionally, the isolating ring member may be a metal spring such as a Bellville-type or wave washer.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1A:
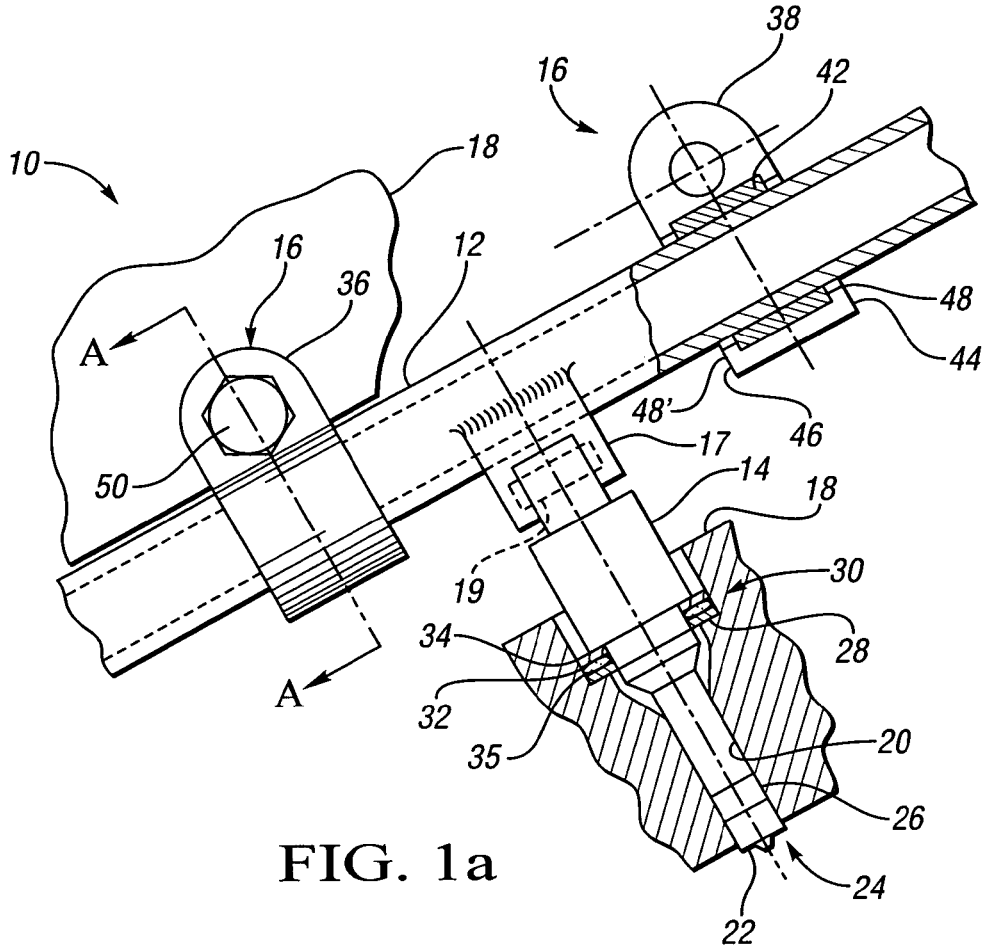
FIG. 1*a* is a fragmentary top elevational view of an isolated fuel delivery system consistent with the present invention illustrating a two-piece clamp assembly.

Referring to the drawings wherein like reference numbers represent like components throughout the several figures, there is shown in FIG. 1*a* an isolated fuel delivery system 10 having a fuel rail 12, a fuel injector 14, and a clamp assembly 16. The fuel rail 12 operates as a conduit to communicate pressurized fuel to the fuel injector 14. Although only one fuel injector 14 is shown in FIG. 1*a*, those skilled in the art will recognize that the fuel rail 12 may operate as a manifold to provide multiple fuel injectors 14 with pressurized fuel. A fuel injector boss 17 is operable to retain one end of the fuel injector 14 with respect to the fuel rail 12, while another end of the fuel injector 14 is disposed within a cylinder head 18. The fuel injector 14 has an injector seal 19, shown in dashed lines, to contain pressurized fuel within the fuel rail 12. The cylinder head 18 defines an injector bore 20, which is dimensioned such that the fuel injector tip 22 can pass though the head 18 to communicate with a combustion chamber 24.

The fuel injector 14 operates to deliver a predetermined amount of fuel, at a specific point in the engine cycle, directly to the combustion chamber 24. An annular combustion seal 26 is provided about the fuel injector tip 22 to disallow the pressurized gasses within the combustion chamber 24 from traversing the injector bore 20. A circumferential land 28 is provided within the injector bore 20 as a means to locate the fuel injector 14 within the cylinder head 18. Disposed between the land 28 and the fuel injector 14 is an isolating ring assembly 30. The isolating ring assembly 30 includes an isolating ring member 32 disposed between first and second stiffening members 34 and 35, respectively. The isolating ring member 32 may be made from a viscoelastic material or an elastic material such as rubber. The first and second stiffening members 34 and 35 may be made of any material with sufficient structural rigidity, such as steel, aluminum, composites, etc., to distribute axial forces to the isolating ring member 32. The first and second stiffening members 34 and 35 may be bonded to the isolating ring member 32 using adhesives known in the art. In addition to providing a measure of vibratory isolation to the isolated fuel delivery system 10, the isolating ring assembly 30 operates to limit the heat transfer between the cylinder head 18 and the fuel within the isolated fuel delivery system 10. An alternate method of isolating the fuel injector 14 from the cylinder head 18 could employ a Belleville-type or wave washer operable to provide compliance and therefore a measure of isolation within the fuel injector 14 to cylinder head 18 interface.

Figure 1B:
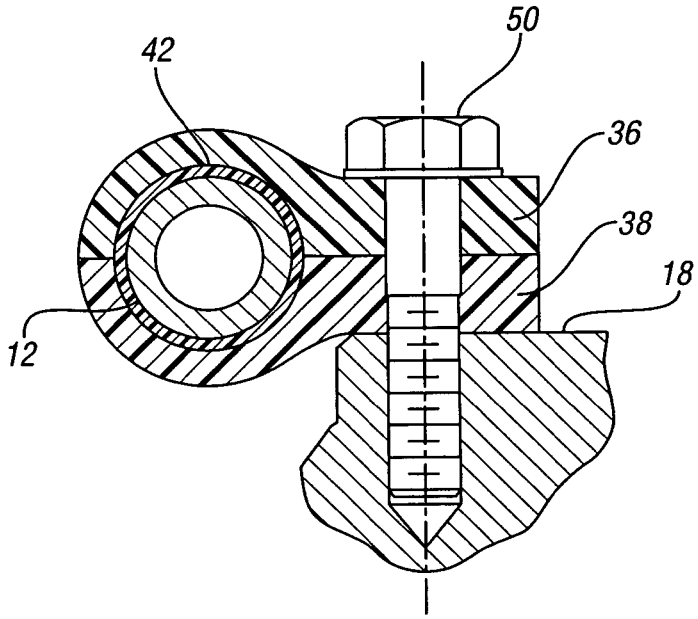
FIG. 1*b* is a fragmentary cross sectional view of the isolated fuel delivery system shown in FIG. 1, taken along line A-A of FIG. 1*a;*
Figure 2:
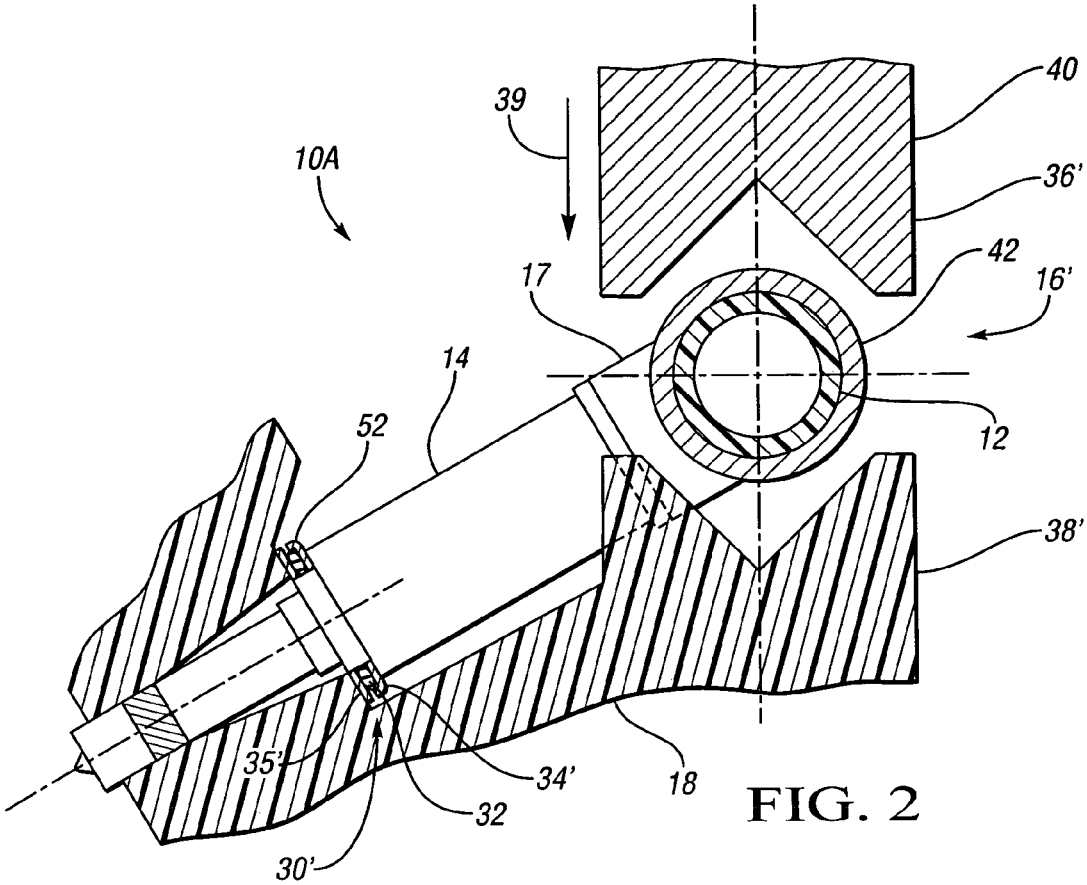
FIG. 2 is a fragmentary and partially exploded cross sectional view of an alternate embodiment of the isolated fuel delivery system shown in FIG. 1 having a first clamping member and a second clamping member integrated into an intake manifold and a cylinder head, respectively.

The clamp assembly 16 includes a first clamping member 36 and a second clamping member 38, both of which cooperate to removably attach the fuel rail 12 to one of the cylinder head 18, as shown in FIGS. 1*a* and 1*b* or to an intake manifold 40, as shown in FIG. 2 and described more particularly hereinafter. An isolating member 42 is at least partially disposed between each of the first and second clamping members 36 and 38, respectively, and the fuel rail 12. The isolating member 42 operates to isolate the fuel rail 12 from the cylinder head 18. The first and second clamping members 36 and 38 each have a first edge 44 and a second edge 46, each of which may have a radially inwardly projecting annular lip portion 48 an 48', respectively. The lip portions 48 and 48' operate to contain and position the isolating member 42 within the first and second clamping member 36 and 38. The annular lip portions 48 and 48' are spaced from the fuel rail 12 by a predetermined distance sufficient to prevent contact between the fuel rail 12 and the first and second clamping members 36 and 38 when the clamp assembly 16 is compressed. The annular lip portions 48 and 48' operate to limit the motion of the fuel rail 12 should the isolating member 42 become overloaded or overstressed. A hex head fastener or fastener 50 may be used to secure the fuel rail 12 to the cylinder head 18. Although a hex head fastener is shown in FIG. 1*a*, those skilled in the art will recognize that alternate fastening methods may be employed, such as a stud and nut.

Referring now to FIG. 1*b* a fragmentary cross sectional view of the isolated fuel delivery system 10 shown in FIG. 1*a* is illustrated. The cross section is taken along line A-A of FIG. 1*a* and further illustrates the interrelation between the first and second clamping members 36 and 38, the fuel rail 12, and the isolating member 42.

Referring now to FIG. 2, there is shown an isolated fuel delivery system 10A. In this embodiment, a clamp assembly 16' has a first clamping member 36' that is integral with the intake manifold 40 of the internal combustion engine (not shown). Additionally, the clamp assembly 16' has a second clamping member 38' that is integral with the cylinder head 18. The intake manifold 40 is lowered, in the direction indicated by arrow 39, onto the cylinder head 18 thereby capturing or retaining the isolating member 42 and the fuel rail 12. By incorporating the first and second clamping members 36' and 38' into the intake manifold 40 and the cylinder head 18, respectively, the need for the fastener 50 (shown in FIGS. 1*a* and 1*b*) is obviated.

An isolating ring assembly 30' is shown in FIG. 2. The isolating ring assembly 30' includes the isolating ring member 32 disposed between a first and a second stiffening member 34' and 35', respectively. As shown, the first stiffening member 34' has a tab portion 52 extending axially from the outer periphery of the first stiffening member 34'. The tab portion 52 operates to contain and locate the isolating ring member 32 within the isolating ring assembly 30'. Additionally the tab portion 52 may be dimensioned to operate to set the crush limit of the isolating ring assembly 30'. In operation, as the fuel pressure within the fuel rail 12 increases and the engine load increases, the need to isolate the fuel delivery system 10A becomes less important as various other sounds emitted by the powertrain are greater than those emanating from the fuel delivery system 10A. Therefore, as the fuel pressure rises within the fuel rail 12, the fuel injector 14 will exert additional force against the isolating ring assembly 30' causing the tab portion 52 to "ground" against the second stiffening member 35'. Those skilled in the art will recognize that the lip portion 52 may be integrated into the first stiffening ring member 34', as shown in FIG. 2, and/or second stiffening member 35'. The tab portion 52 may span substantially the entire circumference of one or both of the first and second stiffening members 34' and 35' or any portion thereof. The first and second stiffening members 34' and 35' may be made of any material with sufficient structural rigidity, such as steel, aluminum, composites, etc., to distribute axial forces to the isolating ring member 32. Additionally, the first and second stiffening members 34' and 35' may be bonded to the isolating ring member 32.

Figure 3:
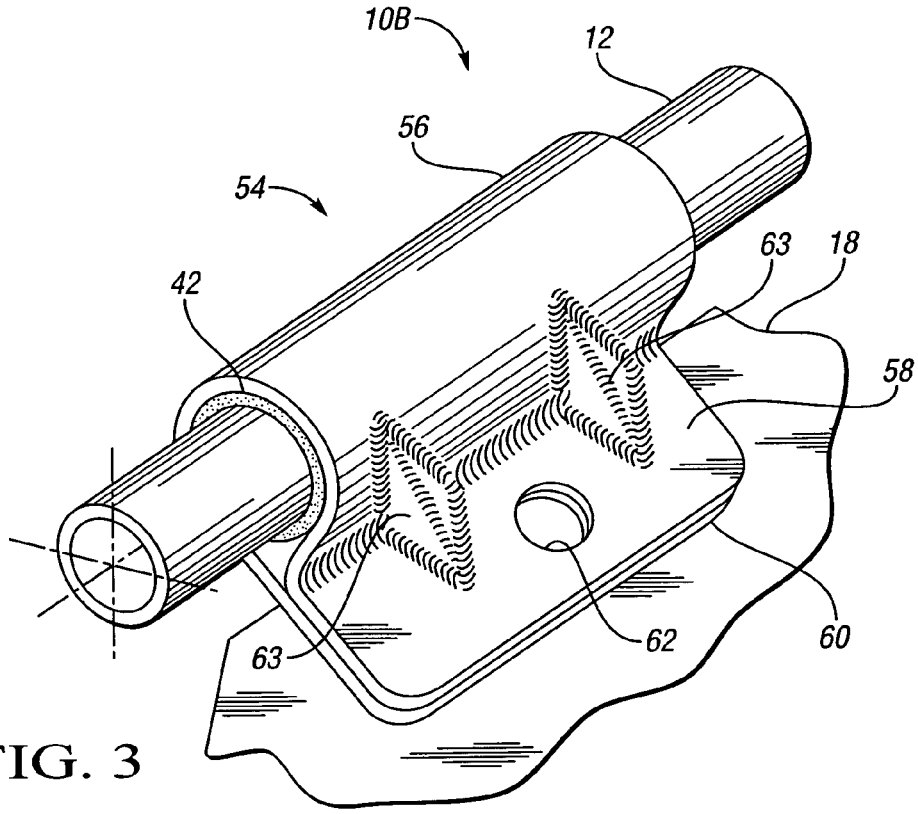
FIG. 3 is a fragmentary perspective view of another embodiment of the isolated fuel delivery system of the present invention illustrating a one-piece clamp design.

In FIG. 3 there is shown an isolated fuel delivery system 10B. The isolated fuel delivery system 10B includes a one-piece clamping member 54 having a clamping portion 56 defining a cavity with generally the same cross sectional shape as the fuel rail 12, and operable to contain the fuel rail 12 with the isolating member 42 disposed therebetween. The clamping portion 56 has a first flange portion 58 and a second flange portion 60 extending therefrom and operable to provide an attachment provision to removably attach the isolated fuel delivery system 10B to the cylinder head 18. A bore 62 is defined by both the first and second flange portions 58 and 60, and is dimensioned to receive a fastener, such as the hex head fastener 50, shown in FIGS. 1*a* and 1*b*. However, those skilled in the art will recognize that other types of fasteners may be used while remaining within the inventive concept. A plurality of stiffening gussets 63 may be added to the one-piece clamping member 54 to provide the requisite structural rigidity. The one-piece clamping member 54 is preferably made from sheet metal, such as stainless steel, steel, or aluminum. To install the one-piece clamping member 54 to the fuel rail 12, the first flange portion 58 and the second flange portion 60 are biased or spread apart from each other to provide adequate clearance for the fuel rail 12 and isolating member 42 to engage the clamping portion 56.

Figure 4:
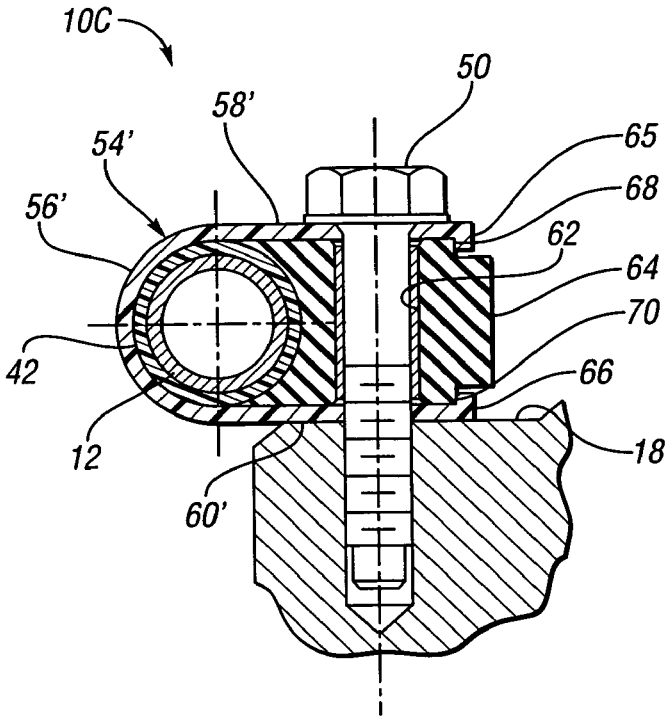
FIG. 4 is a fragmentary cross sectional view of yet another embodiment of the isolated fuel delivery system of the present invention illustrating a clamp design similar to the one-piece clamp shown in FIG. 3.

In FIG. 4 there is shown an isolated fuel delivery system 10C illustrating a one-piece clamping member 54' which cooperates with a shim block 64 to retain the isolating member 42 and the fuel rail 12. The one-piece clamping member 54' has a clamping portion 56' with a first flange portion 58' and a second flange portion 60' extending therefrom. The first flange portion 58' has a first tab portion 65 extending therefrom at an edge farthest from the clamping portion 56'. Likewise, the second flange portion 60' has a second tab portion 66 extending therefrom at an edge farthest from the clamping portion 56'. The first and second tab portions 65 and 66 engage a first ridge 68 and a second ridge 70 of the shim block 64, respectively. In doing so, the isolating member 42 is pre-compressed by a predetermined amount prior to installation of the isolated fuel delivery system 10C on the engine. A bore 62 is defined by the first flange portions 58', second flange portions 60', and the shim block 64. The bore 62 is dimensioned to receive the hex head fastener 50, which operates to removably attach the isolated fuel delivery system 10C to the cylinder head 18. The shim block 64 ensures that the isolating member 42 does not become over compressed if the specified torque on the fastener 50 is exceeded. The one-piece clamping member 54' is preferably made from sheet metal, such as stainless steel, steel, or aluminum. The shim block 64 may be formed from powdered metal, aluminum, composites, etc.

The isolated fuel delivery systems 10 (shown in FIG. 1*a* and 1*b*), 10A (shown in FIG. 2), 10B (shown in FIG. 3), and 10C (shown in FIG. 4) each provide a slight amount of movement to allow radial and axial positioning of the fuel rail 12 within the clamp assemblies 16, 16' and one-piece clamping members 54, 54'. Thus, allowing greater tolerance to build variations when positioning the fuel injector 14. The clamp assemblies 16, 16' and one-piece clamping members 54, 54' may extend substantially the length of the fuel rail 12 or any portion thereof. By increasing the area of the isolating member 42, the reaction forces may be distributed over a greater area, thereby decreasing the pressure acting on the isolating member 42.

Figure 5:
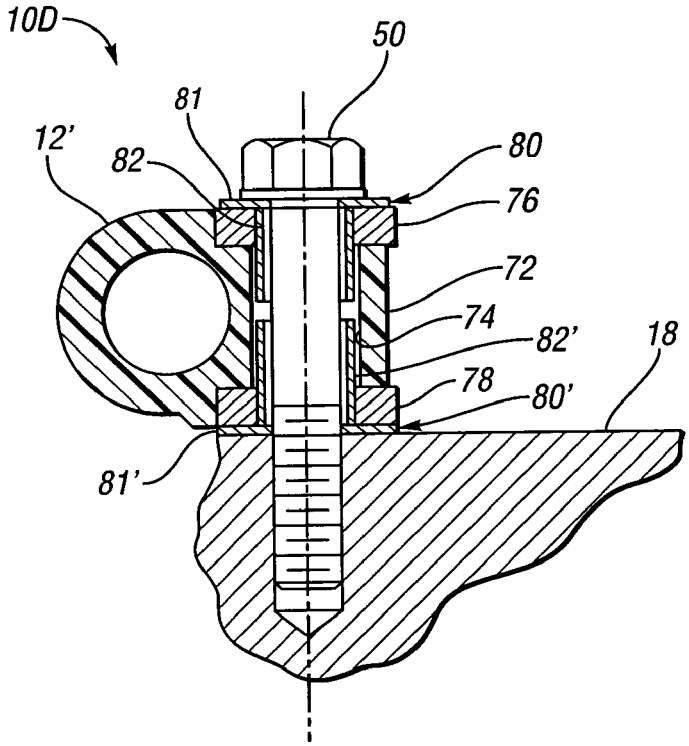
FIG. 5 is a fragmentary cross sectional view of still another embodiment of the isolated fuel delivery system illustrating a fuel rail having a mounting portion with isolating members disposed on each side of the mounting boss portion.

FIG. 5 illustrates an isolated fuel delivery system 10D. A fuel rail 12' has a mounting boss portion 72 that defines a bore 74. At opposite axial ends of the mounting boss portion 72 there is disposed a first isolating member 76 and a second isolating member 78. A crush sleeve 80 has a washer portion 81 and a sleeve portion 82 extending axially therefrom. The sleeve portion 82 extends though the first isolating member 76 and at least partially into the bore 74 defined by the mounting boss portion 72. A crush sleeve 80' has a washer portion 81' and a sleeve portion 82' extending axially therefrom. The sleeve portion 82' extends though the second isolating member 78 and at least partially into the bore 74 defined by the mounting boss portion 72. The sleeve portions 82, 82' and the washer portions 81 and 81' may be integral, i.e. one-piece designs, or separate pieces. The fastener 50 operates to removably attach the isolated fuel delivery system 10D to the cylinder head 18. The axial height of length of the crush sleeve portions 82 and 82' determine the preload or compression limit on the first and second isolating members 76 and 78 when the fastener 50 is torqued. The crush sleeves 80 and 80' provide a measure of protection against over compression of the first and second isolating members 76 and 78 should the fastener 50 be over torqued.

Figure 6A:
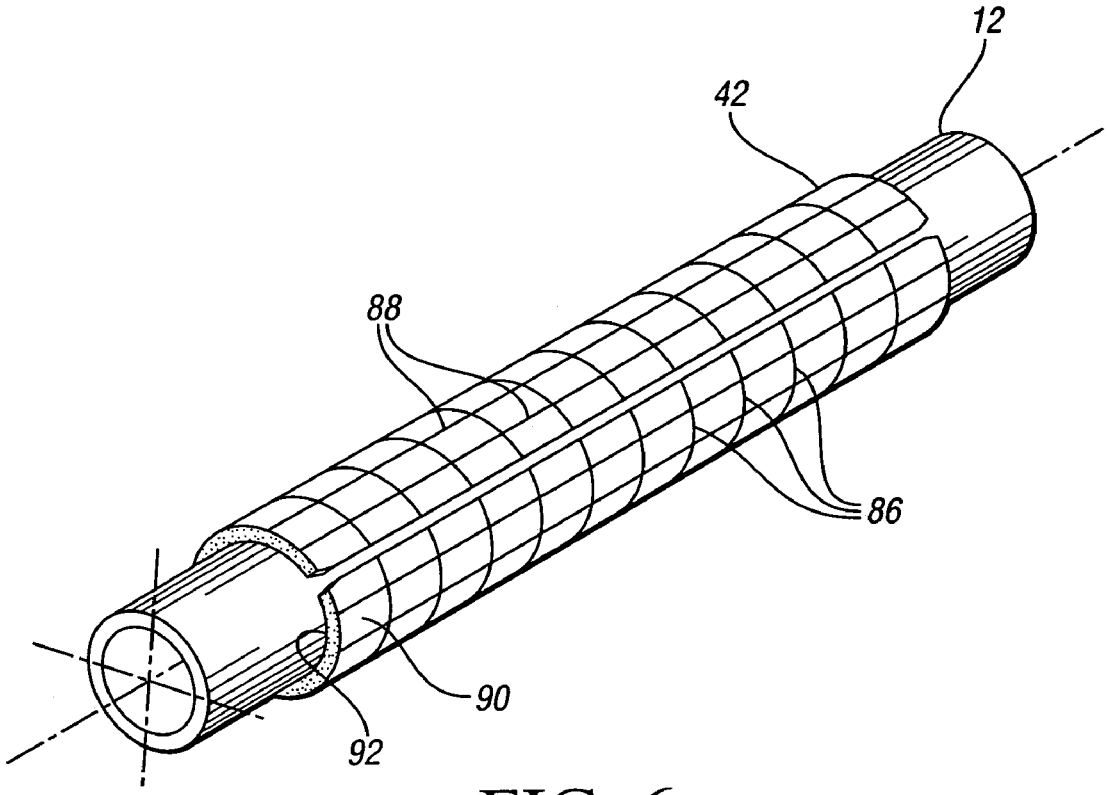
FIG. 6*a* is a perspective view of an isolating member operable to isolate a fuel rail.
Figure 6B:
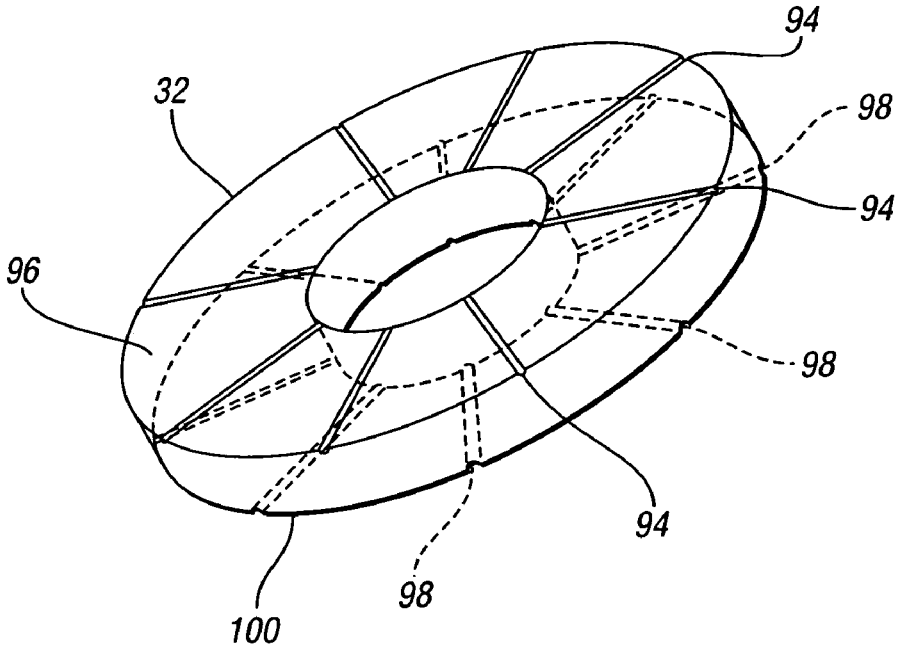
FIG. 6*b* is a perspective view of an isolating ring member operable to isolate a fuel injector from the cylinder head.

FIG. 6*a* is a partial isometric view of the isolating member 42 mounted with respect to the fuel rail 12. The isolating member 42 has a plurality of annularly extending grooves 86 and a plurality of axially extending grooves 88 provided on one or both of a first face 90 and a second face 92 of the isolating member 42. The grooves 86 and 88 provide a volume or void within which the material comprising the isolating member 42 may move when compressed. Those skilled in the art will recognized that the grooves 86 and 88 may be configured in a variety of ways while still remaining within the scope of that which is claimed. FIG. 6*b* is a plan view of the isolating ring member 32, shown in FIGS. 1*a* and 2. A plurality of radially extending grooves 94 are provided on a first face 96 of the isolating ring member 32. Likewise, a plurality of radially extending grooves 98, shown in phantom, is provided on a second face 100 of the isolating ring member 32. The grooves 94 and 98 provide a volume or void within which the material comprising the isolating member 42 may move when compressed. Preferably, the respective radial centerlines of the grooves 94 and 98 will not coincide. Those skilled in the art will recognized that the grooves 94 and 98 may be configured in a variety of ways, such as annular oriented grooves, while still remaining within the scope of that which is claimed.

The isolated fuel delivery systems 10 (shown in FIG. 1*a* and 1*b*), 10A (shown in FIG. 2), 10B (shown in FIG. 3), and 10C (shown in FIG. 4) and 10D (shown in FIG. 5) provide a measure of thermal insulation since conductivity is minimized through the use of isolator members. This is beneficial to reduce heating of the fuel within the fuel system of the vehicle.

While the best modes for carrying out the invention have been described in detail, those familiar with the art to which this invention relates will recognize various alternative designs and embodiments for practicing the invention within the scope of the appended claims.

The invention claimed is:

1. An isolated fuel delivery system for an internal combustion engine having a cylinder head and an intake manifold, the isolated fuel delivery system comprising:

a fuel rail operable to deliver fuel to at least one fuel injector;

said fuel rail having at least one mounting boss portion defining a bore;

said bore being configured to receive a fastener;

said fastener being operable to removably attach said fuel rail to one of the cylinder head and the intake manifold;

a plurality of isolating members each disposed at a respective opposite axial end of said at least one mounting boss portion;

wherein said plurality of isolating members operate to damp the vibrations of said fuel rail; and a first crush sleeve and a second crush sleeve provided coaxial to said fastener, said first crush sleeve and said second crush sleeve being operable to limit the compression of said plurality of isolating members.

2. The isolated fuel delivery system of claim 1, further comprising: an isolating ring assembly disposed between said at least one fuel injector and the cylinder head, said isolating ring assembly being operable to isolate said at least one fuel injector.

3. The isolated fuel delivery system of claim 1, wherein said plurality of isolating members includes a first isolating member disposed at a first axial end of said at least one mounting boss portion and a second isolating member disposed at a second axial end of said at least one mounting boss portion, wherein said second axial end is opposite said first axial end.

4. The isolated fuel delivery system of claim 1, wherein said at least one crush sleeve includes a washer portion and a sleeve portion extending axially from said washer portion.

5. The isolated fuel delivery system of claim 4, wherein said sleeve portion of said at least one crush sleeve extends through said first isolating member.

6. The isolated fuel delivery system of claim 5, wherein said sleeve portion of said at least one crush sleeve extends at least partially into said bore defined by said at least one mounting boss portion.

7. The isolated fuel delivery system of claim 4, wherein said washer portion and said sleeve portion are integral with each other.

* * * * *